US009260827B2

(12) United States Patent
Bertz et al.

(10) Patent No.: US 9,260,827 B2
(45) Date of Patent: Feb. 16, 2016

(54) ROAD FINISHING MACHINE WITH CONTROLLABLE CONVEYOR DEVICES

(71) Applicant: JOSEPH VOGELE AG, Ludwigshafen/Rhein (DE)

(72) Inventors: Klaus Bertz, Dittelsheim-Hessloch (DE); Tobias Noll, Roschbach (DE); Ralf Weiser, Ladenburg (DE); Alessandro De Santis, Lambsheim (DE)

(73) Assignee: JOSEPH VOGELE AG, Ludwigshafen/Rhein (DE)

( * ) Notice: Subject to any disclaimer, the term of this patent is extended or adjusted under 35 U.S.C. 154(b) by 82 days.

(21) Appl. No.: 13/751,303

(22) Filed: Jan. 28, 2013

(65) Prior Publication Data

US 2013/0195550 A1 Aug. 1, 2013

(51) Int. Cl.

| | |
|---|---|
| ***E01C 21/00*** | (2006.01) |
| ***E01C 19/48*** | (2006.01) |
| ***E01C 19/20*** | (2006.01) |

(52) U.S. Cl.

CPC ..... *E01C 21/00* (2013.01); *E01C 19/48* (2013.01); *E01C 2019/2065* (2013.01)

(58) Field of Classification Search

USPC ..... 404/75, 84.05, 84.1, 108; 222/71

See application file for complete search history.

(56) References Cited

U.S. PATENT DOCUMENTS

| | | | | |
|---|---|---|---|---|
| 3,537,363 | A * | 11/1970 | Long et al. | 404/84.05 |
| 3,678,817 | A * | 7/1972 | Martenson et al. | 404/72 |
| 3,967,912 | A * | 7/1976 | Parker | 404/84.05 |
| 5,575,583 | A * | 11/1996 | Grembowicz et al. | 404/72 |
| 5,863,149 | A * | 1/1999 | Gustin | 404/104 |
| 7,484,911 | B2 | 2/2009 | Frelich | |
| 7,654,769 | B2 | 2/2010 | Herrmann | |
| 8,353,642 | B2 | 1/2013 | Munz et al. | |
| 8,356,957 | B2 | 1/2013 | Weiser | |
| 8,469,630 | B2 * | 6/2013 | Olson et al. | 404/84.05 |
| 2006/0045620 | A1 * | 3/2006 | Olson et al. | 404/84.1 |
| 2008/0038059 | A1 * | 2/2008 | Frelich | 404/75 |
| 2009/0047069 | A1 | 2/2009 | Hermann | |

(Continued)

FOREIGN PATENT DOCUMENTS

| | | | |
|---|---|---|---|
| DE | 2003211 | * | 10/1970 |
| DE | 29612034 U1 | * | 9/1996 |

(Continued)

OTHER PUBLICATIONS

Office action which issued on Mar. 4, 2014 in corresponding Japanese Application No. 2013-012262, with English translation.

(Continued)

*Primary Examiner* — Abigail A Risic
(74) *Attorney, Agent, or Firm* — Fish & Richardson P.C.

(57) ABSTRACT

The invention relates to a road finishing machine with a controllable longitudinal conveyor device and a transverse conveyor device for mixed laying material disposed in the rear in the direction of motion. The road finishing machine furthermore comprises a control unit for adjusting a delivery rate of the longitudinal conveyor device and/or the transverse conveyor device. The control unit is connected with a sensory mechanism for determining a mixed laying material quantity or rate and adjusts the delivery rate in response to a signal from the sensory mechanism representing the mixed laying material quantity or rate. The control unit can be pilot controlled in response to laying parameters by a pilot control unit.

12 Claims, 3 Drawing Sheets

FIG. 1b

(56) References Cited

U.S. PATENT DOCUMENTS

| | | | |
|---|---|---|---|
| 2011/0229263 | A1 | 9/2011 | Buschmann et al. |
| 2011/0229264 | A1 | 9/2011 | Weiser |

FOREIGN PATENT DOCUMENTS

| | | | | |
|---|---|---|---|---|
| DE | 69416664 | T2 | | 9/1999 |
| DE | 20 2004 004 082 | U1 | | 9/2004 |
| DE | 102005040326 | A1 | * | 4/2006 |
| DE | 102007033456 | A1 | * | 2/2008 |
| DE | 19680396 | B4 | * | 10/2010 |
| EP | 0279795 | | * | 8/1988 |
| EP | 2025811 | A1 | * | 2/2009 |
| EP | 2366830 | A1 | * | 9/2011 |
| EP | 2366831 | | * | 9/2011 |
| JP | H10-501859 | A | | 10/1996 |
| JP | 2011-089387 | A | | 4/2011 |

OTHER PUBLICATIONS

European Search Report mailed Jun. 28, 2012, which issued during prosecution of corresponding EP Application No. EP12000504.

Notice of Opposition filed Dec. 15, 2014 against corresponding EP Application No. 2 620 549 B1.

Office Action which issued Nov. 4, 2014 in corresponding Chinese Application No. 201310032533.3, with English translation.

Notice of Opposition for EP Patent No. 2620549 B1 (EP Application No. 12000504.6) dated Feb. 27, 2015 and English translations of Sections III to XI, D10 and D11 and Fig. 4.3 of D14 (284 pp).

Wolfgang Poppy, AsphaltstraSenbau—Zehn Jahre maschinen -und verfahrenstechnische Forschung, Magdeburger Wissenschaftsjournal Jan.-Feb. 2005, S. 24-30, with English Translation.

Dr. -Ing. A. Ulrich, Mannheim, Neue StraSenbautechnik, Tiefbau Nov. 1996, S. 722-730, with English Translation.

Gunnar Johannsen, Mensch—Maschine—Systeme, Springer-Verlag 1993, Inhaltsverzeichnis, S. 107-151, with English Translation.

* cited by examiner

ROAD FINISHING MACHINE WITH CONTROLLABLE CONVEYOR DEVICES

FIELD OF THE INVENTION

The invention relates to a road finishing machine having controllable conveyor devices and to a method of operating a road finishing machine.

BACKGROUND OF THE INVENTION

It is well-known that a road finishing machine has a material conveyor system with which mixed laying material required for road construction is conveyed from a bunker located at the front in the direction of motion to the rear end of the road finishing machine in the direction of motion. For this, such a road finishing machine has a longitudinal conveyor system which is often designed as a scraper belt. In the process, the longitudinal conveyor system conveys the mixed material against the direction of motion from the front to the rear underneath the machine. The transverse conveyor system disposed at the rear end of the road finishing machine, which is often designed as spreading screw, is subsequently used to spread the mixed material in front of a screed and is to ensure the most constant and uniform distribution of the mixed material possible in the direction transverse to the road finishing machine. Such a road finishing machine is disclosed for example, in DE 93 08 170 U1.

It is furthermore known that the material throughput of the mixed material in the longitudinal conveyor system and in the transverse conveyor system depends on several parameters, for example the feed of the road finishing machine, the width of spread, the thickness of spread, and the density of the mixed material. For this reason, U.S. Pat. No. 3,678,817, EP 0 279 795 A2, DE 20 2004 004 082 U1, and DE 196 80 396 B4, for example, suggest systems for controlling the longitudinal and/or transverse conveyor system by open-loop or closed-loop control to adjust the material throughputs of the systems. These systems have in common that they have one or several sensors for detecting the current material throughput and regulate, on the basis of the data received from these sensors, the conveyor speeds or rates, respectively.

It is a disadvantage of the suggested systems that the cooperation of an open-loop or closed-loop control with the sensors for detecting the material throughput exhibits a certain inevitable latency, thus resulting in a delay between the event—namely a disadvantageous change of the material throughput—and the reaction to it. For example, when an extendable screed is employed and extended, the width of spread of the road finishing machine changes, so that an increased demand of mixed material suddenly arises in the region of the screed. The sensor or the sensors notice(s) this only with a certain delay in time, so that the connected open-loop or closed-loop control will try, as a reaction to this and with another increase in latency time, to compensate the increased demand for mixed material by increasing the conveyor rate of the longitudinal and/or the transverse conveyor system. The control is initially started sharply, so that a sudden acceleration of the drives of the material conveyor system occurs. By this, extreme load peaks can occur in the conveyor units or components, respectively, so that the diesel engine of the road finishing machine will get to its limits of performance. This can cause an engine stop as a protective function, and thus a laying stop of the road finishing machine. Such a behavior causes a disadvantageous quality of the road to be constructed and moreover has a disadvantageous effect on the laying speed.

OBJECT OF THE INVENTION

It is therefore the object of the present invention to provide a road finishing machine with an improved conveyor system for the mixed laying material which increases the laying quality of the road finishing machine by means that are constructively as simple as possible.

This object is achieved by the road finishing machine and a method according to the present invention.

In the road finishing machine of the present invention the control unit for adjusting a conveyor rate of the longitudinal and/or the transverse conveyor system can be, in addition to its reaction to the sensor signal, pilot controlled by a pilot control unit, in response to detected laying parameters. This results in quite a number of advantages. By the additional consideration of laying parameters in the controlling process, it is possible to permit a constant working manner of the road finishing machine even if deviating operational conditions occur suddenly. Here, it is possible to react to the changed operational conditions in advance, i. e. before they have an effect at a relevant point of the road finishing machine, and to correspondingly adjust the material conveyor system to this. It is, for example, possible to calculate the theoretically required delivery rate of the longitudinal conveyor device and/or the transverse conveyor device from the laying parameters and to correspondingly pilot control the control unit. This advantageously has the effect that the adjustment with the detection of the changed operational conditions by the sensor or sensors is accomplished more smoothly because, for example, the delivery rate of the conveyor system has been already increased or reduced at this point in time. Thus, load peaks which would result from the sharp adjustment are advantageously avoided.

Here, a variety of laying parameters can be simultaneously detected by the control unit. For example, a calculation of the theoretically required delivery rate can also be done by the control unit as soon as the main switch of the road finishing machine is actuated. The road finishing machine according to the invention thus offers the advantage that by the pilot control of the control unit, a largely constant speed of the conveyor system and thus a constant precompaction of the mixed laying material are achieved. This has a positive effect on the quality of the constructed road. Moreover, the drive units of the road finishing machine are saved.

The laying parameters to be considered for the pilot control of the control unit can be, for example, user inputs and/or machine parameters of the road finishing machine. The advantage of this is that the variety of considered parameters makes it possible to achieve a particularly high quality open-loop or closed-loop control of the conveyor system. In addition, the application efforts for the system are reduced.

It proved to be particularly advantageous if the control unit and/or the pilot control unit can be trained on the basis of the detected laying parameters; i. e. the system is a self-learning system. This permits a self-learning determination of the pilot control values and improves the quality of pilot control.

The laying parameters to be considered by the control unit can be an arbitrary selection (i. e. one laying parameter or several ones) from the width of spread, the steering position, the position of an extendable screed, the thickness of spread, the laying speed, the material stock, the travel drive speed, the driving speed of the road finishing machine, and the lateral inclination of the screed. For example, by the detection and evaluation of the travel drive speed of the right and left sides of the road finishing machine, a cornering of the road finishing machine can be detected. A left curve, for example, requires a higher amount of mixed laying material on the right side of the road finishing machine, and vice-versa. The pilot control of the material conveyor system permits to prevent an unsteady reaction of the conveyor devices caused by cornering in advance by correspondingly pilot controlling the conveyor devices on the basis of the detected cornering. The variety of possible laying parameters effectively increases the quality of the open-loop or closed-loop control of the conveyor system.

Suitably, the control unit can be overridden by the pilot control unit to increase the dependency of the delivery rate on the laying parameters compared to the sensory mechanism. If the sensory mechanism detects, for example, that at present too much mixed laying material is present in the region of the screed, the control unit would cause the delivery rate of the longitudinal and/or transverse conveyor system to be reduced. If, however, the driving speed of the road finishing machine is also increased, or the width of spread is increased, it is advantageous for these parameters to be prioritized by the control unit to avoid hectic or sharp corrections. This has an advantageous effect on the laying quality and additionally reduces load peaks in the drive units of the road finishing machine and the material conveyor system.

Particularly advantageously, a theoretically required delivery rate of the longitudinal and/or transverse conveyor device is calculable and the control unit can be pilot controlled in response to this calculated delivery rate.

It proved to be suitable for the ratio of the delivery rates of the longitudinal and transverse conveyor devices to be variably adjustable with respect to each other. By this, the conveyor system of the road finishing machine can be still more precisely adapted to the operational conditions and the laying quality can be improved thereby.

It is particularly advantageous if the delivery rate of the longitudinal and/or transverse conveyor device can be adjusted by speed-controlled drive units. If, for example, electrically adjustable, hydraulically operated drive units are used for the material conveyor system, the speed of them can be adjusted by a simple regulation of the control current.

It is suitable for the sensory mechanism to comprise at least one contactless level sensor. Basically, any contactless level or flow rate sensor is suited for this. Paddle, ultrasonic and pivoted lever sensors have proved to be particularly suitable.

Advantageously, the road finishing machine according to the invention is a wheeled finisher or a track-laying drive finisher. Thus, the invention can be used in any one of the most frequently used designs of road finishing machines.

The invention also relates to a method for the operation of a road finishing machine. The method according to the invention is characterized in that the control unit for the material conveyor system can be additionally pilot controlled using a pilot control unit in response to laying parameters. The advantage of this is that thereby a pilot control of the drive components of the material conveyor system of the road finishing machine can be effected. This increases the laying quality, avoids sharp adjustments and thus reduces the load peaks occurring in the material conveyor system.

It is suitable to take user inputs and/or machine parameters of the road finishing machine into consideration as laying parameters.

Here, it can also be advantageous if the control unit and/or the pilot control are trained on the basis of the detected laying parameters. This makes the material conveyor system a self-learning system that facilitates the handling of the road finishing machine and can improve the laying quality.

The laying parameters to be taken into consideration can be selected in any desired number (i.e. one or several) from the width of spread, thickness of spread, laying speed, longitudinal position, position of an extendable screed, the material stock in the bunker, the travel driving speed, the drive speed of the complete road finishing machine, and the lateral inclination of the screed. Thus, a wide selection of laying parameters to be considered is available which permits a particularly efficient control of the conveyor system or the pilot control of the latter.

It can also be advantageous if a theoretically required delivery rate of the longitudinal and/or the transverse conveyor device is calculated from the laying parameters and the control unit is pilot controlled in accordance with these conveyors. Thus, the latency time of the open-loop or closed-loop control is advantageously shortened.

BRIEF DESCRIPTION OF THE DRAWINGS

Below, advantageous embodiments of the invention will be illustrated more in detail with reference to a drawing. The drawings show in detail.

Figure 1A:
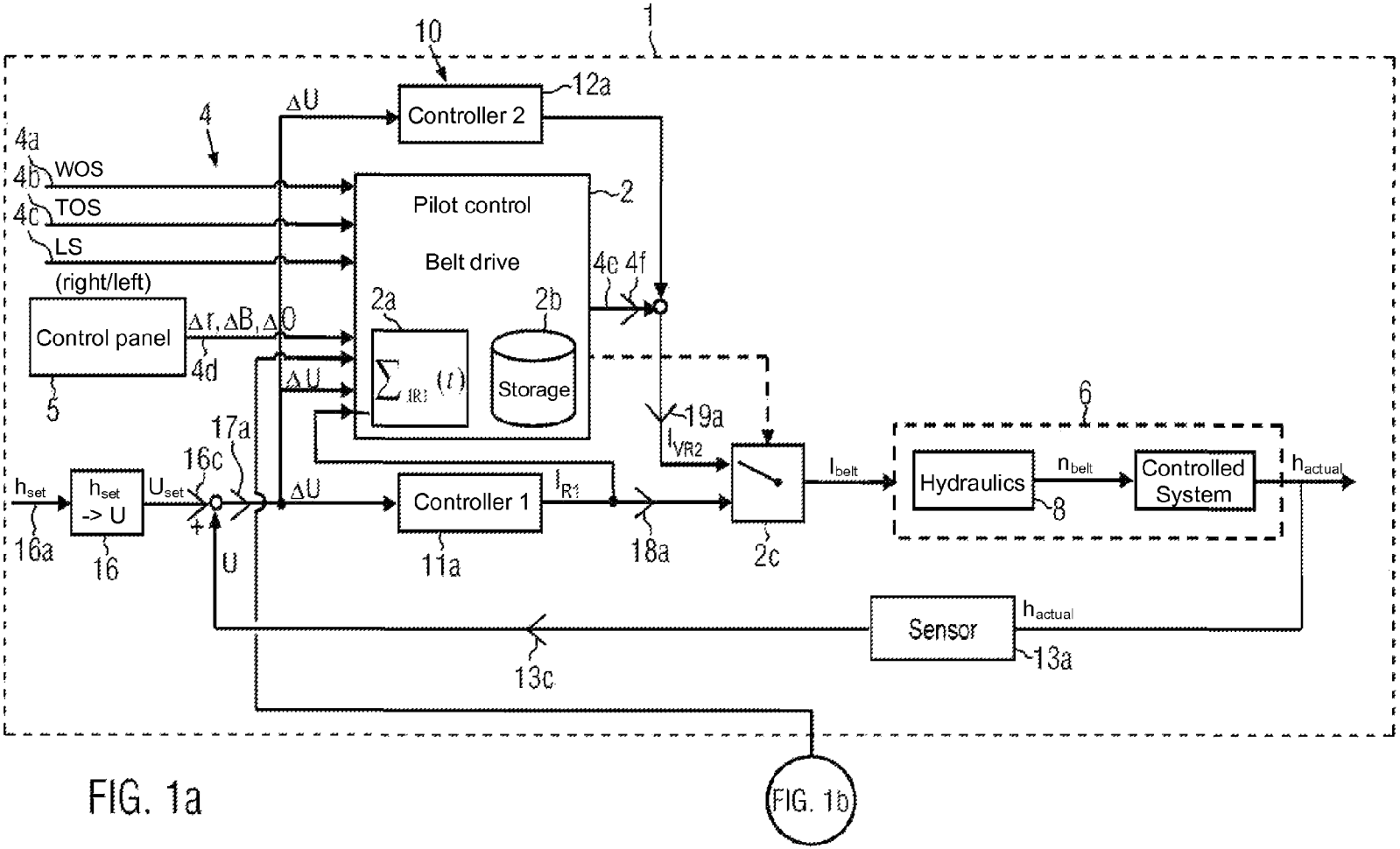
FIGS. 1*a* and 1*b* a highly schematized principal representation of a road finishing machine according to the invention with a pilot control according to the invention for a longitudinal conveyor device (FIG. 1*b*) and a transverse conveyor device (FIG. 1*a*) of a material conveyor system, and FIG. 2 a schematic representation of the functional principle of a pilot control according to the invention for a material conveyor system of a road finishing machine.

Equal components are always provided with equal reference numerals in the figures.

DETAILED DESCRIPTION OF THE INVENTION

Figure 1B:
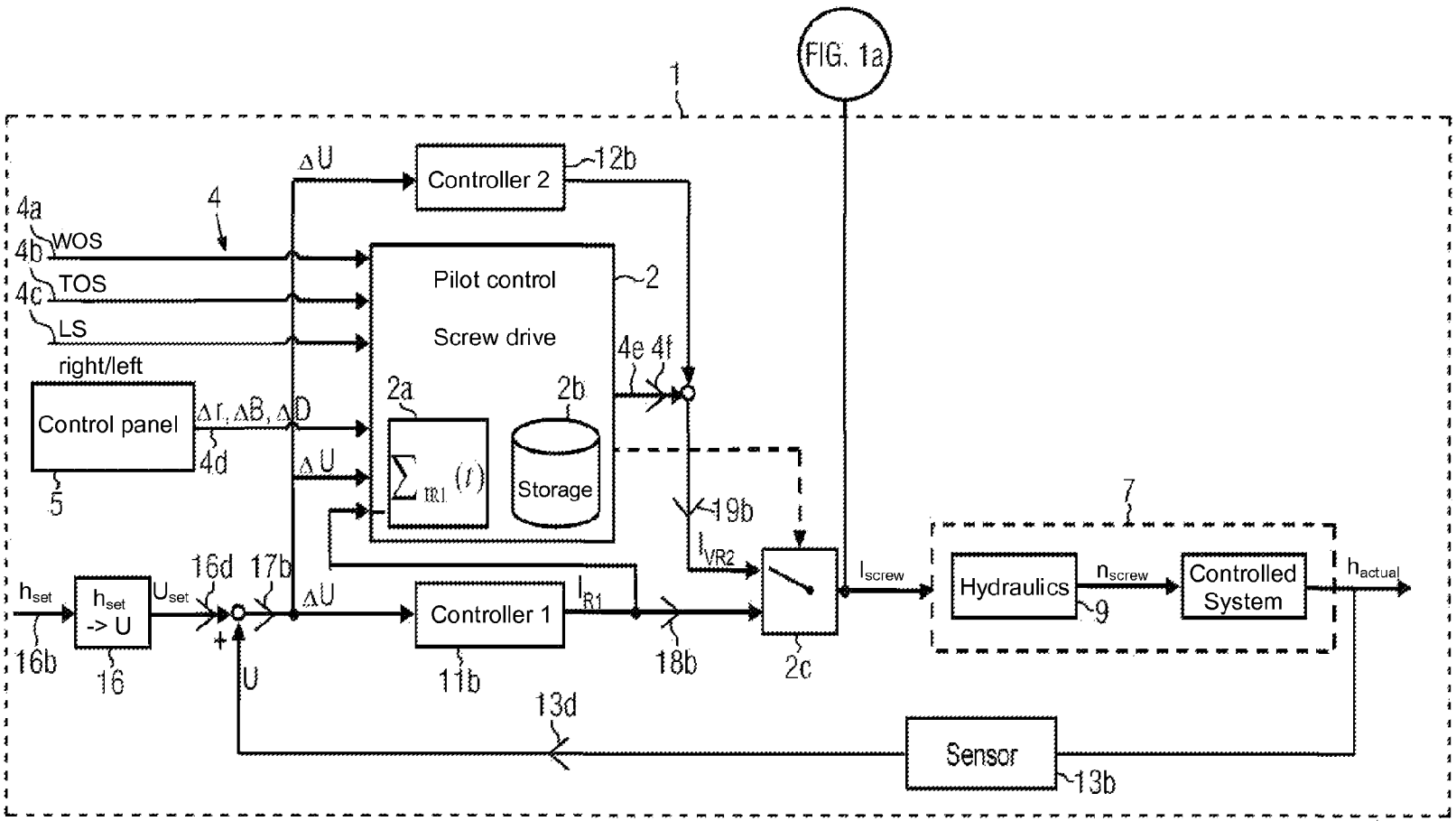

FIG. 1 shows a highly schematized representation of a road finishing machine 1 according to the invention with a pilot control unit 2 according to the invention for a material conveyor system 3 of the road finishing machine 1. The road finishing machine 1 can be a wheeled finisher or a track-laying drive finisher.

The pilot control unit 2 is, for example, integrated in an electronic control apparatus with at least one computing unit 2*a*, a data storage 2*b*, and a switch 2*c* and furthermore has a plurality of inputs 4 for detecting laying and/or machine parameters 4*a*, 4*b*, 4*c*, 4*d*, and an output 4*e* for outputting at least one computable output signal 4*f*. For transmitting the parameters 4*a*, 4*b*, 4*c*, 4*d* to the pilot control unit 2, the road finishing machine 1 comprises a control panel 5. The parameters 4*a*, 4*b* and 4*c* are, for example, the width of spread (WOS), the thickness of spread (TOS), and the laying speed (LS).

The shown material conveyor system 3 comprises a longitudinal conveyor device 6 for conveying a mixed laying material from the front part in the direction of motion of the road finishing machine to the rear part of the road finishing machine 1. The longitudinal conveyor device 6 is preferably a two-piece scraper belt. Furthermore, the finishing machine 1 comprises a transverse conveyor device 7 which is preferably a transverse spreading screw. In FIG. 1, only one side of each the longitudinal and transverse conveyor devices 6, 7 is shown, the other side being constructed analogously.

For driving the longitudinal conveyor device 6, the shown material conveyor system 3 has a hydraulic drive unit 8 which drives the longitudinal conveyor device 6 at an adjustable speed. Furthermore, the material conveyor system 3 has a further hydraulic drive unit 9 for driving the transverse conveyor device 7. For this, the drive unit 9 drives the transverse spreading screw at an adjustable speed.

For controlling a driving speed or a delivery rate of the material conveyor system 3, the road finishing machine 1 has a control unit 10 integrated in an electronic control device, which is schematically shown in FIG. 1. The control unit 10 can here be combined with the pilot control unit 2 to a common control device, be embodied separately or integrated in any other control device of the road finishing machine 1. The control unit 10 has a first controller 11*a*, 11*b* and a second controller 12*a*, 12*b* each for controlling the hydraulic drive units 8, 9. The first controllers 11*a*, 11*b* are each configured to generate a control current for the hydraulic drive units 8, 9. The second controllers 12*a*, 12*b* are each configured to cooperate with the pilot control 2, i. e. they are designed to cooperate with a pilot control signal of the pilot control 2 generated at the output 4*e*.

The road finishing machine 1 furthermore has a sensory mechanism comprising at least one sensor 13*a* for monitoring the longitudinal conveyor device 6, and a further sensor 13*b* for monitoring the transverse conveyor device 7. Both sensors 13*a*, 13*b* can be of the same design, preferably an ultrasonic, paddle or pivoted lever sensor. All sensors 13*a*, 13*b* are configured to cooperate with the control unit 10 or connected to the latter using electric lines. It is also possible to provide a separate sensor for each side of the longitudinal conveyor device 6, i. e. for each individual scraper belt, and/or for each part of the transverse conveyor device 7, i. e. for each individual transverse spreading screw. The sensors 13*a*, 13*b* are each designed to generate an electric signal 13*c*, 13*d* which represents the filling level of the mixed laying material in a certain region of the material conveyor system 3.

The operation of the above-described road finishing machine 1 can proceed as described below.

Figure 2:
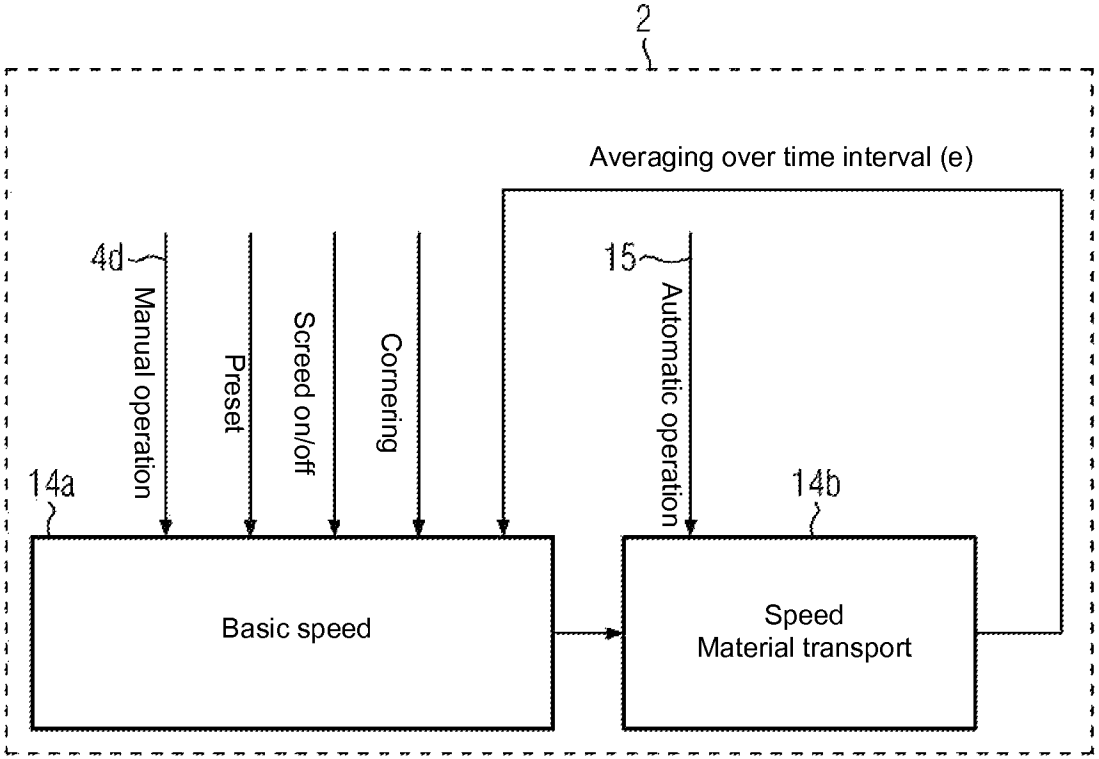

FIG. 2 schematically shows the functional principle of the pilot control 2. In this embodiment, the pilot control 2 determines, on the basis of several laying and machine parameters applied to the input 4, a basic speed 14*a* for the longitudinal conveyor device 6 and/or the transverse conveyor device 7. The basic speed 14*a* is here either determined by manual operation, i. e. by the manual input 4*d* by an operator at the control panel 5 of the road finishing machine 1, or the operator calls site data stored in the data storage 2*b* of the pilot control 2, so-called PRESET data, and the basic speed 14*a* is adjusted correspondingly. Another possibility is to consider the laying parameters 4*a*, 4*b*, 4*c*. Thus, the basic speed 14*a* can be controlled, for example, in response to the manually changed width of spread or a cornering drive.

The pilot control 2 combines the basic speed 14*a* with an automatic mode 15 to a driving speed 14*b* of the drive units 8, 9 of the longitudinal and/or transverse conveyor devices 6, 7 to be adjusted. The automatic mode 15 here considers the signals 13*c*, 13*d* generated by the sensors 13*a*, 13*b* as to the current filling level of the material conveyor system 3.

With reference to FIG. 1, the cooperation of the pilot control unit 2 with the control unit 10 will be illustrated below. A setpoint setting 16 for a material height 16*a* of the longitudinal conveyor device 6 and a further material height 16*b* of the transverse conveyor device 7 is preset for the material conveyor system 3. The material heights 16*a*, 16*b* are each represented by a target voltage 16*c*, 16*d* within the material conveyor system 3. The signals 13*c*, 13*d* generated by the sensors 13*a*, 13*b* represent the current material height in the material conveyor system 3 in the form of an electric voltage, i.e. the actual voltage. From the voltage signals 13*a*, 13*b* and 16*c*, 16*d*, the control unit 10 now calculates a deviation 17*a*, 17*b* of the target heights 16*a*, 16*b* from the actual material heights.

The first controllers 11*a*, 11*b* are each set to the target voltage 16*c*, 16*d* to preset a control current 18*a*, 18*b* for the drive units 8, 9 of the material conveyor system 3. By the switch 2*c* of the pilot control 2, the control currents 18*a*, 18*b* are connected, and the drive units 8, 9 are driven at the corresponding speed. This influences or changes, respectively, the value of the signals 13*c*, 13*d* representing the actual material height.

The pilot control 2 according to the invention also makes it possible to record the control currents 18*a*, 18*b* for the drive units 8, 9 in the data storage 2*b*. From the recorded or stored control currents 18*a*, 18*b*, the pilot control 2 can draw conclusions on the present laying situation by calculation and generate further target control currents 19*a*, 19*b*. If these target control currents 19*a*, 19*b* determined from the recorded control currents 18*a*, 18*b* are present, the pilot control 2 activates these values instead of the target control currents 18*a*, 18*b* by actuating the switch 2*c*. That means that either the control currents 18*a*, 18*b* of the first controllers 11*a*, 11*b*, or the target control currents 19*a*, 19*b* influenced by the second controllers 12*a*, 12*b* and the pilot control 2 are activated by the switch 2*c*, i. e. supplied to the drive units 8, 9.

The pilot control 2 according to the invention in accordance with FIG. 1 thereby enables the following possible applications or operating phases in the operation of the road finishing machine 1:

- In one operating phase, the switch 2*c* is in a lower switch position to activate the first controllers 11*a*, 11*b*. Simultaneously, the pilot control unit 2 is configured to record the control currents 18*a*, 18*b* determined by the first controllers 11*a*, 11*b* in the data storage 2*b* for a time period that can be set in more detail, e. g. determined by the operator or applied to the system (training the pilot control 2). In this operating phase of the pilot control 2, no pilot control of the material conveyor system 3 is yet effected. This is only influenced by the data from the sensors 13*a*, 13*b* and the control characteristics of the first controllers 11*a*, 11*b*.
- If the switch 2*c* is, however, in an upper switch position to activate the second controllers 12*a*, 12*b*, the output signal 4*f* of the pilot control 2 is taken into consideration in the control current for the drive units 8, 9 calculated for the laying situation. The second controllers 12*a*, 12*b* are configured to combine the signal 4*f* with the signals 13*c*, 13*d*. This operating phase corresponds to a pilot control of the material conveyor system 3 by the pilot control 2.
- In the upper position of the switch 2*c*, it is also possible to increase the weighting of the pilot control 2 or of the signal 4*f* generated by it compared to the second controller 12*a*, 12*b* in order to override the control characteristics of the second controllers 12*a*, 12*b* of the pilot control 2, or vice-versa to reduce the weighting.

Starting from the described embodiment, the road finishing machine 1 according to the invention or the functioning of the pilot control 2, respectively, can be modified in many ways.

Optionally, only the laying and/or machine parameters applied to the inputs 4 of the pilot control 2 can be taken into consideration for determining the target control currents 19*a*, 19*b* for the drive units 8, 9. It is also possible to take into consideration, together or separately, the width of spread, the thickness of spread and the laying speed of the right and the left travel drives of the road finishing machine 1 for the calculation of the target control currents 19*a*, 19*b*. Here, it is also conceivable that the steering angle of a road finishing machine 1 is included in the calculation.

It is furthermore possible that for the pilot control of the longitudinal conveyor device 6, the control current 19*b* of the transverse conveyor device 7 is additionally monitored and taken into consideration in the calculation of the target control current 19*a*. By this, the speed presetting for the longitudinal conveyor device 6 can be done simultaneously with the speed presetting for the transverse conveyor device 7, and a material undersupply in a region between the longitudinal conveyor and transverse conveyor devices 6, 7 can be prevented.

For cost reasons, it is furthermore possible in the road finishing machine according to the invention to separately control and/or pilot-control only one part of the material conveyor system i. e. either the longitudinal conveyor device 6 or the transverse conveyor device 7.

The invention claimed is:

1. A road finishing machine comprising:

a controllable longitudinal conveyor device and a controllable transverse conveyor device each for conveying mixed laying material, the transverse conveyor device being disposed behind the longitudinal conveyor device in the moving direction of the road finishing machine, and a control unit for adjusting a delivery rate of at least one of the longitudinal conveyor device or the transverse conveyor device, the control unit being connected to a sensory mechanism for determining at least one of a mixed laying material quantity or a mixed laying material rate, the delivery rate being adjustable in response to a signal received from the sensory mechanism representing at least one of the mixed laying material quantity or the mixed laying material rate, wherein the control unit is pilot controllable in response to laying parameters using a pilot control unit, and wherein the laying parameters comprise user inputs and the control unit can be overridden by the pilot control unit to increase the dependency of the delivery rate on the laying parameters compared to the sensory mechanism.

2. Road finishing machine according to claim 1, wherein at least one of the control unit or the pilot control unit is trainable based on the laying parameters.

3. Road finishing machine according to claim 1, wherein the laying parameters comprise at least one member selected from the group consisting of the width of spread, the thickness of spread, the laying speed, the steering position, the position of an extendable screed, the material stock, the travel drive speed, the driving speed of the road finishing machine, and the lateral inclination of the screed.

4. Road finishing machine according to claim 1 wherein a theoretically required delivery rate of at least one of the longitudinal conveyor device or the transverse conveyor device is computable and the control unit is pilot controllable in response to the computed delivery rate.

5. Road finishing machine according to claim 1 wherein the ratio of the delivery rates of the longitudinal conveyor device and the transverse conveyor device is variably adjustable with respect to each other.

6. Road finishing machine according to claim 1, further-comprising speed-controlled drive units that can adjust the delivery rate of at least one of the longitudinal conveyor device or the transverse conveyor device.

7. Road finishing machine according to claim 1 wherein the sensory mechanism comprises at least one level sensor.

8. Road finishing machine according to claim 1 wherein the road finishing machine comprises a wheeled finisher or a track-laying drive finisher.

9. Method of operating a road finishing machine having a controllable longitudinal conveyor device and a controllable transverse conveyor device each for conveying mixed laying material, the transverse conveyor device being disposed behind the longitudinal conveyor device in the direction of motion, and having a control unit for adjusting a delivery rate of at least one of the longitudinal conveyor device or the transverse conveyor device, wherein the control unit is connected to a sensory mechanism, the method comprising determining at least one of a mixed laying material quantity or a mixed laying material rate, adjusting the delivery rate in response to a signal of the sensory mechanism representing at least one of the mixed laying material quantity or the mixed laying material rate, using a pilot control unit to pilot control the control unit in response to laying parameters, wherein user inputs are considered as laying parameters and the control unit can be overridden by the pilot control unit.

10. Method according to claim 9 which comprises training at least one of the control unit or the pilot control unit based on the laying parameters.

11. Method according to claim 9 which comprises selecting at least one laying parameters from the group consisting of width of spread, thickness of spread, laying speed, steering position, position of an extendable screed, material stock, travel drive speed, driving speed of the road finishing machine and the angle of inclination of the road finishing machine.

12. Method according to claim 9 which comprises calculating a theoretically required delivery rate of at least one of the longitudinal conveyor device or the transverse conveyor device from the laying parameters and adjusting the control unit with the pilot control corresponding to this delivery rate.

* * * * *